US007707993B2

(12) United States Patent
Coldren et al.

(10) Patent No.: US 7,707,993 B2
(45) Date of Patent: May 4, 2010

(54) ELECTRONIC PRESSURE RELIEF IN A MECHANICALLY ACTUATED FUEL INJECTOR

(75) Inventors: Dana R. Coldren, Secor, IL (US); Yongxiang Li, Peoria, IL (US); Victor I. Yacoub, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 12/214,928

(22) Filed: Jun. 24, 2008

(65) Prior Publication Data

US 2009/0314259 A1 Dec. 24, 2009

(51) Int. Cl.
*F02M 51/00* (2006.01)
*F02B 3/00* (2006.01)

(52) U.S. Cl. ..... 123/473; 123/299

(58) Field of Classification Search ..... 123/299, 123/473, 506

See application file for complete search history.

(56) References Cited

U.S. PATENT DOCUMENTS 4,739,797 A * 4/1988 Scheffel ..... 137/625.69
5,315,978 A 5/1994 Ishida
5,619,969 A 4/1997 Liu et al.
5,682,858 A 11/1997 Chen et al.
5,819,704 A * 10/1998 Tarr et al. ..... 123/467
5,957,111 A * 9/1999 Rodier ..... 123/458
6,279,542 B1 8/2001 Lindblom
6,279,543 B1 * 8/2001 Niethammer et al. ..... 123/506
6,279,843 B1 * 8/2001 Coldren et al. ..... 239/585.1
6,336,444 B1 * 1/2002 Suder ..... 123/496
6,390,069 B1 * 5/2002 Jiang et al. ..... 123/506
6,439,202 B1 * 8/2002 Carroll et al. ..... 123/467
6,527,199 B1 3/2003 Schwarz
6,595,189 B2 * 7/2003 Coldren et al. ..... 123/467
6,604,507 B1 * 8/2003 Lei et al. ..... 123/446

(Continued)

FOREIGN PATENT DOCUMENTS

JP 2002-130078 5/2002

OTHER PUBLICATIONS

Hsieh, Application of Computational Fluid Dynamics for Flow Force Optimization of a High Pressure Fuel Injector Spill Valve, article, 1999, pp. 1-10, 1999-01-1537, SAE.

*Primary Examiner*—Stephen K Cronin
*Assistant Examiner*—David Hamaoui
(74) *Attorney, Agent, or Firm*—Liell & McNeil; Carl E. Myers

(57) ABSTRACT

A mechanically actuated electronically controlled fuel injector includes a first electrical actuator that controls the position of a spill value, and a second electrical actuator to control pressure on a closing hydraulic surface associated with a nozzle check valve. The fuel injector is actuated via rotation of a cam to move a plunger to displace fuel from a fuel pressurization chamber either to a spill passage or at high pressure out of a nozzle outlet of the fuel injector for an injection event. Pressure in the fuel injector is moderated when the plunger is moving and the nozzle check valve is in a closed position by briefly cracking open the spill valve to relieve some pressure during the dwell between injection events, such as between a large main injection event and a small close coupled post injection event. This strategy allows for longer dwell times between injection events as well as smaller injection quantities in the post-injection.

7 Claims, 2 Drawing Sheets

U.S. PATENT DOCUMENTS 6,694,952 B1 * 2/2004 Yamazaki et al. ..... 123/496
6,796,290 B2 9/2004 Boehland et al.
6,976,474 B1 * 12/2005 Coldren et al. ..... 123/446
7,111,613 B1 * 9/2006 Barnes et al. ..... 123/467
7,134,616 B2 * 11/2006 Dong et al. ..... 239/533.8
2003/0029421 A1 * 2/2003 Coldren et al. ..... 123/446
2003/0127532 A1 * 7/2003 Coldren et al. ..... 239/5
2004/0108394 A1 * 6/2004 Lawrence et al. ..... 239/533.2
2005/0150972 A1 * 7/2005 Dong et al. ..... 239/5
2005/0194462 A1 * 9/2005 Coldren et al. ..... 239/88
2006/0266335 A1 * 11/2006 Barnes et al. ..... 123/467
2006/0284129 A1 * 12/2006 Krishnaswamy et al. ..... 251/129.15
2007/0137179 A1 * 6/2007 Kondou et al. ..... 60/285
2008/0092853 A1 * 4/2008 Harcombe et al. ..... 123/472
2008/0236549 A1 * 10/2008 Bickley ..... 123/504

* cited by examiner

ELECTRONIC PRESSURE RELIEF IN A MECHANICALLY ACTUATED FUEL INJECTOR

TECHNICAL FIELD

The present disclosure relates generally to mechanically actuated electronically controlled fuel injection systems, and more particularly to a strategy for electronically moderating fuel pressure, such as to achieve small close coupled post injections.

BACKGROUND

Mechanically actuated electronically controlled unit injectors (MEUI) have seen great success in compression ignition engines for many years. In recent years, MEUI injectors have acquired additional control capabilities via a first electrical actuator associated with a spill valve and a second electrical actuator associated with a direct operated nozzle check valve. MEUI fuel injectors are actuated via rotation of a cam, which is typically driven via appropriate gear linkage to an engine's crankshaft. Fuel pressure in the fuel injector will generally remain low between injection events. As the cam lobe begins to move the plunger, fuel is initially displaced at low pressure to a drain via the spill valve for recirculation. When it is desired to increase pressure in the fuel injector to injection pressure levels, the first electrical actuator is energized to close the spill valve. When this is done, pressure quickly begins to rise in the fuel injector because the fuel pressurization chamber becomes a closed volume when the spill valve closes. Fuel injection commences by energizing a second electrical actuator to relieve pressure on a closing hydraulic surface associated with the direct operated nozzle check valve. The nozzle check valve can be opened and closed any number of times to create an injection sequence consisting of a plurality of injection events by relieving and then re-applying pressure onto the closing hydraulic surface of the nozzle check valve. These multiple injection sequences have been developed as one strategy for burning the fuel in a manner that reduces the production of undesirable emissions, such as NOx, unburnt hydrocarbons and particulate matter, in order to avoid over reliance on an exhaust aftertreatment system.

One multiple injection sequence that has shown the ability to reduce undesirable emissions includes a relatively large main injection followed closely by a small post injection. Because the nozzle check valve must inherently be briefly closed between the main injection event and the post-injection event, pressure in the fuel injector may surge due to the continued downward motion of the plunger in response to continued cam rotation. Thus, if the dwell between the main injection event and the post-injection event is too long, the increased pressure in the fuel injector will undermine the ability to controllably produce small post injection quantities. In other words, the longer the dwell, the larger the post injection quantity becomes. Thus, the inherent structure and functioning of MEUI injectors makes it difficult to control fuel pressure during an injection sequence because the fuel pressure is primarily dictated by plunger speed (engine speed) and the flow area of the nozzle outlets, if they are open. Again, when the nozzle outlets are closed, the fuel has nowhere to go and pressure surges within the fuel injector. As expected, this pressure surging problem can become more pronounced at higher engine speeds and loads, which may be the operational state at which a closely coupled small post injection is most desirable.

The present disclosure is directed to overcoming one or more of the problems set forth above.

SUMMARY

In one aspect, a method of operating a fuel injector includes closing a spilled valve while a plunger of the fuel injector is moving in response to rotation of a cam. Fuel pressure in the fuel injector is moderated above a valve opening pressure of a nozzle check valve, while the plunger is moving and the nozzle check valve is closed, by opening the spill valve. After initiating the moderating step, the nozzle check valve is opened.

In another aspect, a fuel system includes at least one cam actuated fuel injector with a plunger operably coupled to a rotating cam. The fuel injector includes at least one electrical actuator operably coupled to a spill valve and a nozzle check valve with a closing hydraulic surface exposed to fluid pressure and a needle control chamber. An electronic controller is in communication with the at least one electrical actuator, and includes a pressure moderating algorithm programmed for execution by a processor. The pressure moderating algorithm is operable to generate control signals to the at least one electrical actuator for moderating fuel pressure above a valve opening pressure of the nozzle check valve, while the plunger is moving and the nozzle check valve is closed. The spill valve opens and closes responsive to the control signals.

DETAILED DESCRIPTION

Figure 1:
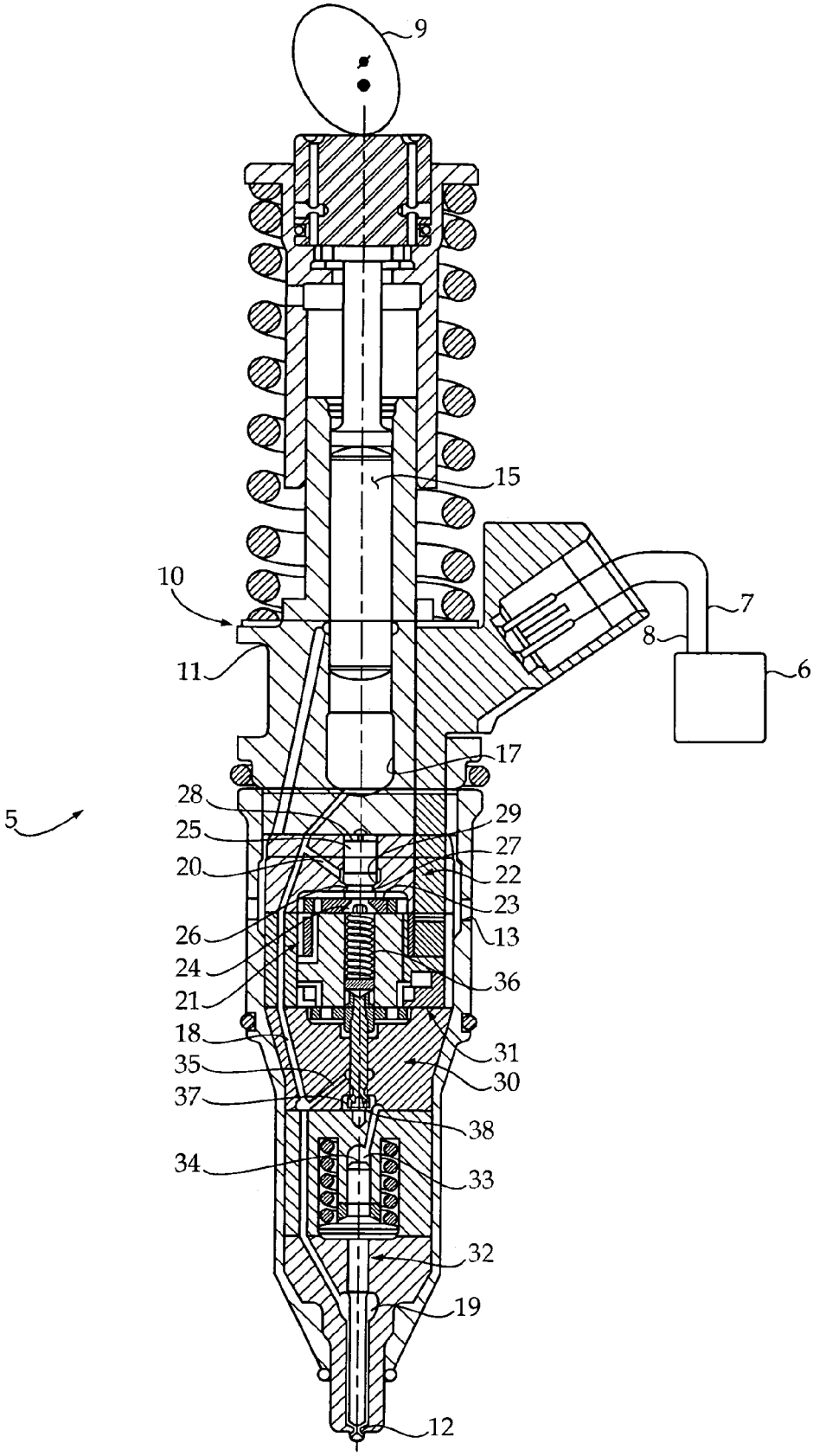
FIG. 1 is a side sectioned diagrammatic view of a fuel injector according to one aspect of the present disclosure.

Referring to FIG. 1, a fuel system 5 includes a mechanical electronic unit injector 10 that is actuated via rotation of a cam 9 and controlled by an electronic controller 6. Fuel injector 10 includes a first electrical actuator 21 operably coupled to a spill valve 22, and a second electrical actuator 31 operably coupled to control pressure in a needle controlled chamber 33 via a needle control valve 30. The first and the second electrical actuators 21 and 31 respectively, are energized and de-energized via control signals communicated from electronic controller 6 via communication lines 7 and 8, which may be wireless. Fuel injector 10 includes an injector body 11 made up of a plurality of components that together define several fluid passageways and chambers. In particular, a fuel pressurization chamber 17 is defined by injector body 11 and a cam driven plunger 15. When plunger 15 is driven downward due to rotation of cam 9, fuel is displaced into a spill passage 20, past spill valve 22, and out a drain passage (not shown) fluidly connected to fuel supply/return opening 13. When first electrical actuator 21 is energized, a spill valve member 25 is moved with an armature 23 until a valve surface 26 comes in contact with an annular valve seat 29 to close spill passage 20. When this occurs, fuel pressure in fuel pressurization chamber 17 increases, as well as a fuel pressure in nozzle chamber 19 via the fluid connection provided by fuel passage 18. Spill valve member 25 is normally biased to a fully open position where end 28 comes in contact with a stop surface via a compression biasing spring 36. Spill valve member 25 is attached to move with armature 23 via fastener 24. Biasing spring 36 also serves to bias the needle control valve 30 to a configuration in contact with flat seat 37 in order to fluidly connect needle controlled chamber 33 to pressure communication passage 35, which is fluidly connected to fuel passage 18.

Pressure in needle control chamber 33 acts upon a closing hydraulic surface 34 associated with nozzle check valve 32. As long as pressure in needle control chamber 33 is high, nozzle check valve 32 will remain in a closed position blocking nozzle outlets 12. When second electrical actuator 31 is energized, needle control valve 30 moves to a position in contact with conical seat 38 to block pressure communication passage 35, and instead fluidly connects needle control chamber 33 to low pressure fuel supply/return opening 13 via a passage not shown. When pressure in needle control chamber 33 is low and pressure in nozzle chamber 19 is above a valve opening pressure of the nozzle check valve 32, the nozzle check valve 32 will lift to an open position to allow fuel to spray through nozzle outlets 12, in a conventional manner.

Although not necessary, spill valve member 25 may have a fluid flow force imbalance shape. A fluid flow force imbalance refers to a phenomenon that may occur due to fluid pressure forces acting upon spill valve member 25 as fuel flows along its outer surface and past seat 29. An imbalance refers to a geometrical structure that causes a net flow force in a closing direction, especially when spill valve member 25 is partially open and fluid flow speeds are high in the vicinity of annulus 27 that terminates in valve surface 26. In a typical flow imbalance situation, the speed of fuel flow adjacent one wall of an annulus will be greater than the other wall, resulting in a stagnation pressure greater at the wall where fluid is moving slower, which in turn results in a net fluid force in that direction acting on the spill valve member. In the present case, that fluid flow force imbalance may occur at the wall of the annulus 27 remote from valve surface 26, resulting in a fluid flow force imbalance that tends to push the spill valve member 25 back toward its closed position. Although some versions of a fuel injector 10 according to the present disclosure may utilize a spill valve member 25 with a fluid flow force imbalance shape, spill valve geometries having fluid flow force characteristics and geometries with an imbalance tending to urge the spill valve toward an open position are also within the intended scope of the present disclosure. Spill valve member geometry that exhibits neutral fluid flow force behavior is also within the intended scope of the present disclosure.

In one aspect, fluid flow force imbalances can be exploited to utilize the spill valve 22 as a pressure control mechanism that permits the spill valve to be just barely cracked open to relieve some pressure, and then rely upon a force imbalance to quickly reclose the spill valve before too much fuel pressure is lost. For instance, current to electrical actuator 21 may be reduced sufficiently that spring 36 begins moving spill valve member off its seat, but the flow that is initiated causes the flow force imbalance force to dominate, resulting in the spill valve member returning to its seat. This re-closes the valve and stops the flow imbalance force. As long as the reduced current to the actuator is maintained, the spill valve member will chatter at its seat cracking open and then re-closing, and repeating this cycle many times. However, even without exploiting a flow force imbalance, the spill valve 22 may have the ability to be cracked open and then quickly re-closed simply through control signals to first electrical actuator 21. For instance, briefly reducing an energization level or completely de-energizing electrical actuator 21 for a brief instant and then resuming the energization level may allow the spill valve member to briefly move off its seat 29 to moderate pressure in nozzle chamber 19 and fuel pressurization chamber 17 via fuel passage 18 and spill passage 20, while still maintaining fuel pressure above the valve opening pressure of the nozzle check valve 32.

As stated above, if a multiple injection sequence is desired, the nozzle check valve 32 must briefly be closed between injection events. While closed and with plunger 15 continuing to move, the fuel has no place to go and pressure may rapidly increase. The present disclosure contemplates an electronic strategy for moderating that pressure surge between injection events by briefly cracking the spill valve 22 open during the dwell between the two injection events. In this way, when it comes time to re-open the nozzle check valve for the post-injection event, pressure in fuel injector 10 will be lower than it otherwise would be, allowing for a smaller and more desirable quantity post injection event. In addition, through suitable control signals to first electrical actuator 21, the spill valve 22 maybe cracked open one, two or more times in order to increase the dwell to some desired dwell duration without allowing fuel pressure to drop below a valve opening pressure of nozzle check valve 32. The valve opening pressure for nozzle check valve 32 refers to what pressure must be in nozzle chamber 19 in order to lift nozzle check valve 32 toward an open position against the action of a biasing spring when pressure in needle controlled chamber 33 is low.

INDUSTRIAL APPLICABILITY

The present disclosure finds potential application to any fuel system that utilizes mechanically actuated electronically controlled fuel injectors that include at least one electrical actuator operably coupled to a spill valve and a nozzle check valve. Although both the spill valve and the nozzle check valve may be controlled with a single electrical actuator within the intended scope of the present disclosure, a typical fuel injector according to the present disclosure will include a first electrical actuator associated with the spill valve and a second electrical actuator associated with the nozzle check valve. Any electrical actuator may be compatible with the fuel injectors of the present disclosure, including solenoid actuators as illustrated, but also other electrical actuators including piezo actuators. The present disclosure finds particular suitability in compression ignition engines that benefit from an ability to produce injection sequences that include a relatively large main injection followed by a closely coupled small post-injection, especially at higher speeds and loads in order to reduce undesirable emissions at the time of combustion rather than relying upon after-treatment systems. The present disclosure also recognizes that every fuel injector exhibits a minimum controllable injection event duration, below which behavior of the injector becomes less predictable and more varied.

Figure 2A:
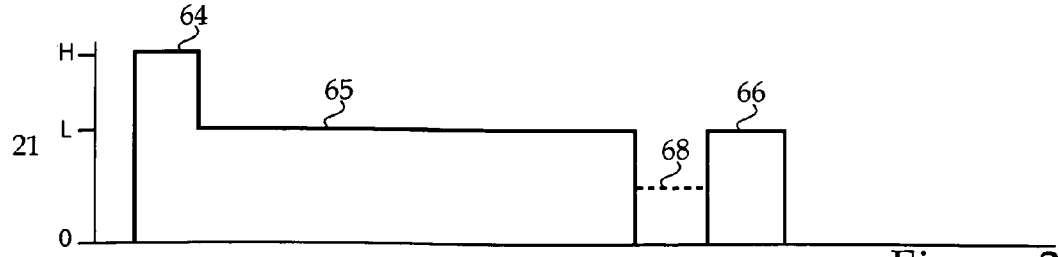
FIGS. 2A-F represent graphs of a first electrical actuator control signal, spill valve position, a second electrical actuator control signal, needle control chamber pressure, injection pressure, and injection rate, respectively, versus time for an example main plus post injection sequence according to the present disclosure, and with a comparison to the prior art.
Figure 2B:
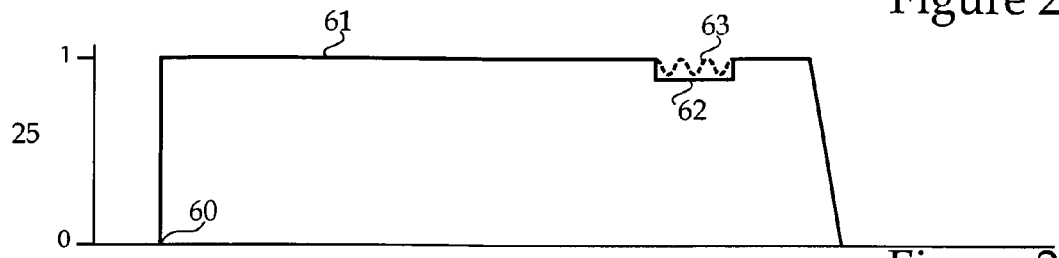
Figure 2C:
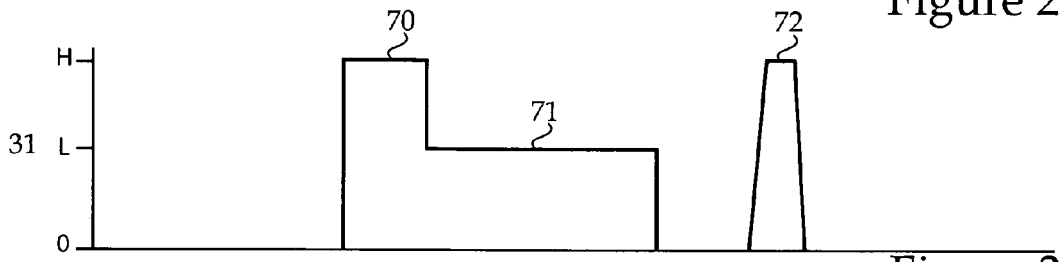
Figure 2D:
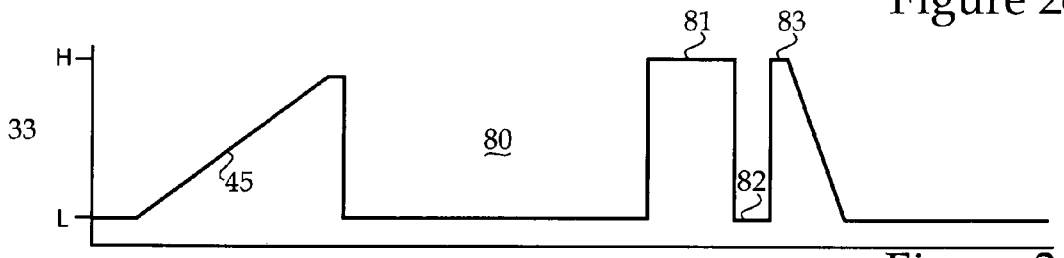
Figure 2E:
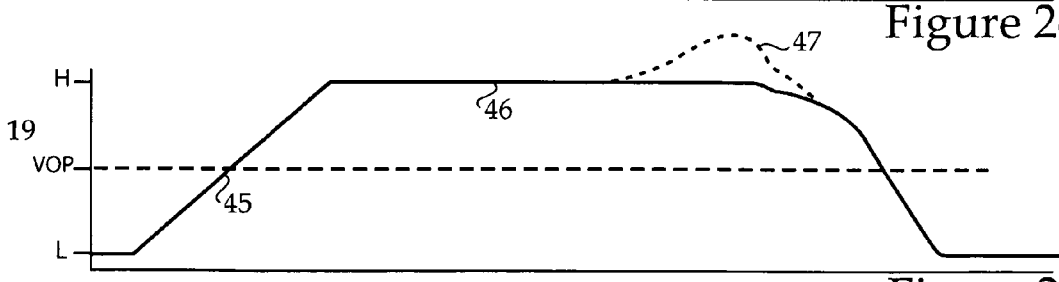
Figure 2F:
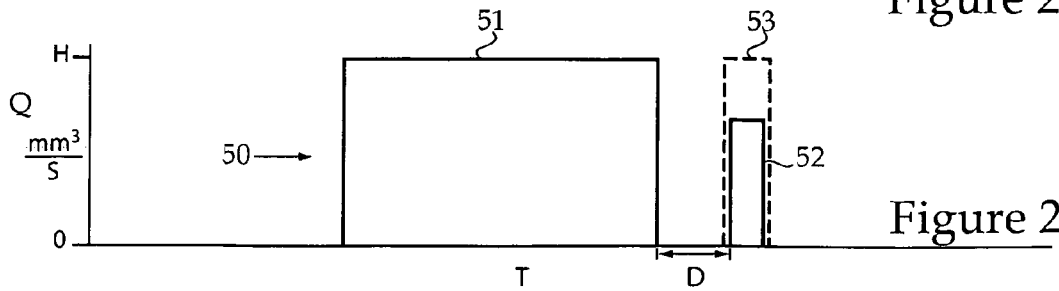

Referring now to FIGS. 2A-F, an injection sequence 50 that includes a large main injection 51 and a closely coupled small post injection 52 is shown in FIG. 2F. Also shown is a similar result with a large post injection 53 according to the prior art using the same fuel injector 10. Any injection sequence generally begins when the lobe of cam 9 starts to move plunger 15. As plunger 15 begins moving, first electrical actuator 21 is energized to a pull-in current 64 to close spill valve 22. As cam 9 continues to rotate, pressure in nozzle chamber 19 begins to ramp up as per pressure increase 45 shown in FIG. 2E. The closure of spill valve 22 is reflected in FIG. 2B by the movement of spill valve member 25 from its fully open position 60 to its closed position 61. At this time, second electrical actuator 31 remains de-energized to facilitate a fluid connection via pressure communication passage 35 to needle control chamber 33 so that the pressure therein tracks closely with the pressure increase 45 as shown in FIG. 2D. After spill valve member 25 comes to rest at its closed position, the current or control signal to electrical actuator 21 may be dropped to a hold in level 65 (FIG. 2A) that is sufficient to hold spill valve member 25 in its fully closed position 61 as shown in FIG. 2B. When it comes time to initiate the main injection event 51, second electrical actuator 31 is energized to a pull in current level 70 (FIG. 2C) that moves needle control valve 30 to a position in contact with conical seat 38 to close pressure communication passage 35, but opens needle control chamber 33 to a low pressure drain passage (not shown). This causes pressure to quickly drop as shown in low-pressure region 80 (FIG. 2D) of needle control chamber 33. Because pressure in nozzle chamber 19 is above the valve opening pressure (VOP) as shown in FIG. 2E, nozzle check valve 32 will lift, and fuel will commence to spray out of nozzle outlet 12 for main injection event 51. As with first electrical actuator 21, second electrical actuator 31 may have its control signal dropped to a low or hold in current level 71 after the needle control valve 30 has come to rest as shown in FIG. 2G. The main injection event 51 may be terminated by de-energizing second electrical actuator 31 to increase pressure in needle control chamber 33 as shown at 81 by reclosing flat seat 37. This results in the abrupt closure of nozzle check valve 32 to end injection through nozzle outlets 12.

In the predecessor fuel injector, pressure would begin to increase as per pressure surge 47 during the dwell between main injection event 51 and the post injection event 53 as shown in dotted lines in FIG. 2E. Thus, in the predecessor injector, fuel pressure at the time of post-injection event 53 is relatively high due to pressure surge 47 resulting in a larger than desirable post injection quantity 53. The present disclosure addresses this problem by briefly cracking open spill valve 22 as shown in FIG. 2B at location 62 where spill valve member 25 is moved just off of seat 29 to moderate pressure in nozzle chamber 19 as shown in FIG. 2E, while maintaining that pressure above the valve opening pressure of nozzle check valve 32. FIGS. 2A and 2B also show in dotted lines an example case where the spill valve member 25 exhibits the force imbalance phenomenon discussed earlier. In particular, current is dropped to a lower level 68 which allows biasing spring 36 to move valve member 25 off its seat 29, but the resulting flow induces a return force that re-closes the seat 29. This behavior repeats as per the dotted line saw tooth shaped chatter 63 shown in FIG. 2B. By moderating the pressure surge 47 while maintaining the pressure above the valve opening pressure of nozzle check valve 32, little to no delay will occur when the nozzle check valve 32 is again reopened after time dwell D to perform a small post injection event 52 as shown in FIG. 2F. The small post injection event 52 is accomplished by re-energizing the second electrical actuator 31 as shown at 72 to drop pressure in needle control chamber 33 as shown at region 82 of FIG. 2D after initiating the pressure moderating step. Thereafter, second electrical actuator 31 is de-energized to again increase pressure in needle control chamber 33 to end the injection sequence 50. Those skilled in the art will appreciate that the injection event could also conceivably be ended by the lobe of cam 9 passing its peak, or by opening spill valve 22 to relieve pressure in fuel injector 10 to below the valve closing pressure sufficient to maintain nozzle check valve 32 in its open position. The valve closing pressure and the valve opening pressure may be similar in magnitude.

The present disclosure has the advantage of achieving small post injections 52 following relatively large main injections 50 with substantial control over the duration of the dwell between injection events in order to achieve better emissions without any changes to existing hardware. Moreover, the strategy of the present disclosure may achieve even more controllable results by possibly exploiting the use of a spill valve member 25 with a fluid flow force imbalance shape in order to exploit fluid forces to quickly re-close the spill valve 22 rather than over reliance on quicker acting electrical actuators to re-pull the spill valve member 25 to its closed position.

The events illustrated in FIGS. 2A-F are accomplished by an electronic controller executing a fuel injection control algorithm programmed for execution by a processor of the controller 6. The fuel injection control algorithm includes many features known in the art, but also includes a pressure moderating algorithm operable to generate control signals to the at least one electrical actuator 21 and 31 for moderating fuel pressure above a valve opening pressure of the nozzle check valve 32 while the plunger 15 is moving and the nozzle check valve 32 is closed. The fuel injection control algorithm might employ the pressure moderating algorithm at any suitable time when plunger 15 is moving and nozzle check valve 32 is closed, but may more specifically execute the pressure moderating algorithm when the fuel injection control algorithm is executing a multiple injection algorithm programmed for execution by the processor. For instance, the multiple injection algorithm may be operable to generate control signals to the first and second electrical actuators 21 and 31, respectively, for injecting fuel in a plurality of injection events of an injection sequence 50, which may include a large main injection 51 followed by a small closely coupled post injection 52. In such a case, the pressure moderating algorithm could be considered a portion of a multiple injection algorithm, which in turn would be a portion of an overall fuel injection control algorithm being periodically executed by electronic controller 6. As discussed earlier, when the pressure moderating algorithm is being executed, the spill valve 22 will partially open 62 but not reach a fully opened position 60 in order to moderate, but not completely dump, the fuel pressure in fuel injector 10. Depending upon the action of spill valve 22, the pressure moderating aspect of the present disclosure could be achieved by either decreasing the energization level of first electrical actuator 31 or completely de-energizing electrical actuator 21, and then increasing the energization level responsive to the execution of the pressure moderating algorithm by the processor of electronic controller 6. Depending upon the sophistication level of fuel system 10, electronic controller 6 might also include a dwell determination algorithm programmed for execution by the processor of electronic controller 6. The dwell determination algorithm would be operable to determine a desired dwell between two injection events. In turn, control signals generated by execution of the pressure moderating algorithm would be responsive to the desired dwell. In extreme cases, the spill valve 22 may be cracked open more than one time in order to achieve longer dwell times than that in the illustrated example injection sequence 50.

Although the present disclosure has been illustrated in the context of moderating fuel pressure between injection events for an injection sequence that includes a large main injection followed by a small post injection, it is foreseeable that the same techniques could be utilized to moderate fuel pressure in the fuel injector at any time that the plunger 15 is moving and the nozzle check valve 32 is closed. Furthermore, it is conceivable that with suitable calibration, the concepts of the present disclosure may actually be exploited to control the magnitude of the injection pressure, and hence injection rate, beyond merely moderating against a pressure surge situation as previously described. For instance, the teachings of the present disclosure might even be utilized to reduce a injection rate during part or all of an injection event to occur at a controlled lower pressure that still is above the valve opening pressure of the nozzle check valve 32. The moderating pressure technique of the present disclosure can be utilized to relax the ever increasing demands for faster and faster electrical actuators associated with both the spill valve 22 and the nozzle check valve 32. Thus, the nozzle check valve 32 may be re-opened while the spill valve 22 is cracked open or after it has reclosed without departing from the present disclosure.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims

What is claimed is:

1. A method of operating a fuel injector to produce multiple injection events during a single injection sequence, comprising the steps of:

closing a spill valve while moving a plunger of the fuel injector in response to rotation of a cam;

moderating fuel pressure in the fuel injector above a valve opening pressure of a nozzle check valve, while the plunger is moving and the nozzle check valve is closed, by at least partially opening the spill valve;

opening the nozzle check valve after initiating the moderating step;

injecting fuel via the nozzle check valve for a first injection event of a plurality of injection events in an injection sequence prior to opening the spill valve; and injecting fuel via the nozzle check valve for a second injection event of the plurality of injection events in the injection sequence responsive to closing the spill valve;

wherein the first injection event is a main injection; and the second injection event is a post injection; and wherein the closing of the spill valve includes a step of closing the spill valve after the moderating step and prior to a spill valve member of the spill valve reaching a fully open position.

2. The method of claim 1 wherein the closing step is accomplished by energizing an electrical actuator; and the moderating step includes reducing an energization level of the electrical actuator.

3. The method of claim 2 further including the steps of mechanically biasing the spill valve member toward the fully open position with a spring;

changing pressure in a needle control chamber; and exposing a closing hydraulic surface of the nozzle check valve to fluid pressure in the needle control chamber.

4. The method of claim 3 wherein the electrical actuator is a first electrical actuator; and the changing pressure step includes changing an energization level of a second electrical actuator.

5. The method of claim 4 further including the steps of determining a desired dwell between the main injection and the post injection; and controlling the moderating step responsive to the desired dwell.

6. The method of claim 5 wherein the step of closing the spill valve after the moderating step includes applying a net fluid pressure force to the spill valve member of the spill valve in a closing direction.

7. The method of claim 5 wherein the moderating step includes de-energizing and re-energizing the second electrical actuator.

* * * * *